US005472751A

United States Patent [19]

Pyron et al.

[11] Patent Number: 5,472,751

[45] Date of Patent: Dec. 5, 1995

[54] ORNAMENT

[75] Inventors: Douglas Pyron, Rehoboth, Mass.; Richard E. Beaupre, Cumberland, R.I.

[73] Assignee: Chemart Company, Lincoln, R.I.

[21] Appl. No.: 117,415

[22] Filed: Sep. 7, 1993

[51] Int. Cl.[6] ..... A47C 25/00

[52] U.S. Cl. ..... 428/28; 428/187; 428/542.2

[58] Field of Search ..... 428/187, 7, 28, 428/187, 542.2

[56] References Cited

U.S. PATENT DOCUMENTS

| | | | |
|---|---|---|---|
| 917,604 | 4/1909 | Herzog | 63/2 X |
| 1,583,022 | 5/1926 | Stanley et al. | 428/187 |
| 3,829,350 | 8/1974 | Davis, Jr. et al. | 428/542.8 X |
| 4,579,768 | 4/1986 | Post | 428/187 |
| 4,693,769 | 9/1987 | Fritz et al. | 428/187 X |
| 5,184,481 | 2/1993 | Joseph et al. | 63/2 X |

*Primary Examiner*—Henry F. Epstein
*Attorney, Agent, or Firm*—Robert J. Doherty

[57] ABSTRACT

An ornament, the blank from which it is formed and the method and device by which it is formed are included. The ornament includes at least two elements both connected to each other at face to face edges via straps which when twisted enable one of the elements to be vertically offset with respect to the other so as to achieve a three dimensional form.

5 Claims, 7 Drawing Sheets

ORNAMENT

BACKGROUND AND OBJECTS OF THE INVENTION

This invention relates to a metal ornament and particularly one or more structural portions thereof juxtaposed in spaced relationship to each other to provide a three-dimensional depth to the completed structure. As such, the invention further relates to the intermediate blank from which the final ornament is constructed as well as the method of re-shaping the blank to provide for the final ornamental three-dimensional effect that is desired.

The subject invention has particular utility with respect to thin, essentially flat metal ornaments which include a portion which is generally a center portion connected to the remaining ornament portion solely by thin connecting means such that the central portion may be upwardly or downwardly bent with respect to the remaining portion to form a resultant ornament having two or possibly more portions at varying heights or depths so as to present a resultant three-dimensional effect. Such ornaments are most often formed from brass, copper, stainless steel and similar thin metallic sheet that can be easily worked and is thereafter either plated or left in its natural state to achieved the desired effect which may include etching or colorization or additional design elements. Such ornaments are particularly popular to annually commemorate different events such as Christmas ornaments for display on trees or in other fashions. With such ornaments, it is often necessary to over bend or over position the movable element with respect to the remaining ornament portion to a position higher or lower than the final intended position to account for metallic memory and the like which often results in excessive bending or breakage. Since the connecting means necessarily must be narrow so as to avoid detracting from the aesthetics of the ornament, such connecting means also can result in the improper positioning of the elements with respect to each and/or requires a relatively high degree of care in displacing one ornament portion from the other therefore raising the cost of the final ornament either through breakage or higher assembly cost.

It would, accordingly, be desirable to provide an ornament, its intermediate blank as well as the method of transforming the blank into the final ornament which avoids these above indicated prior art shortcomings and yet results in an attractive, aesthetically pleasing ornament that can be produced at a reasonable cost.

A further object of the present invention is the provision of an ornament having at least two portions or elements thereof which are adapted to be placed in spaced relationship to each other and connected by means which enables such displacement to be easily and positively made to the point of exact desired displacement between the elements rather than providing for some compensation for relaxation of the metal connection by which the two elements are joined.

A further object of the present invention and particularly useful when the composite elements of the overall ornament are in the form of design portions which are, in essence, concentric with each other is the provision of a blank in which the movable element is nonconcentric but which is swung downwardly laterally to a space concentric position in the final ornament configuration.

A further object is the presentation of a method and equipment by which the immediately preceding objective can be accomplished.

These and other objects of the present invention accomplished by an ornament having first and second metallic elements, said elements each being of a thin, substantially planar sheet-like configuration of equal thickness and having opposed upper and lower surfaces, said element surfaces being of planar geometric configurations in which the first element includes an inner peripheral edge having opposed sides and ends which defines a central opening in which said second element is disposed in a parallel vertically-spaced relationship to said first element, said second element including an outer peripheral edge having opposed sides and ends, said elements integrally attached to each other by at least one integral flat connecting strap extending between said elements between each of their respective side edges, said straps being of the same thickness and material as said elements and of a narrow width and further each partially rotationally twisted about an axis parallel to the flat planes of said elements such that said elements are maintained in their spaced relation by said connecting straps.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
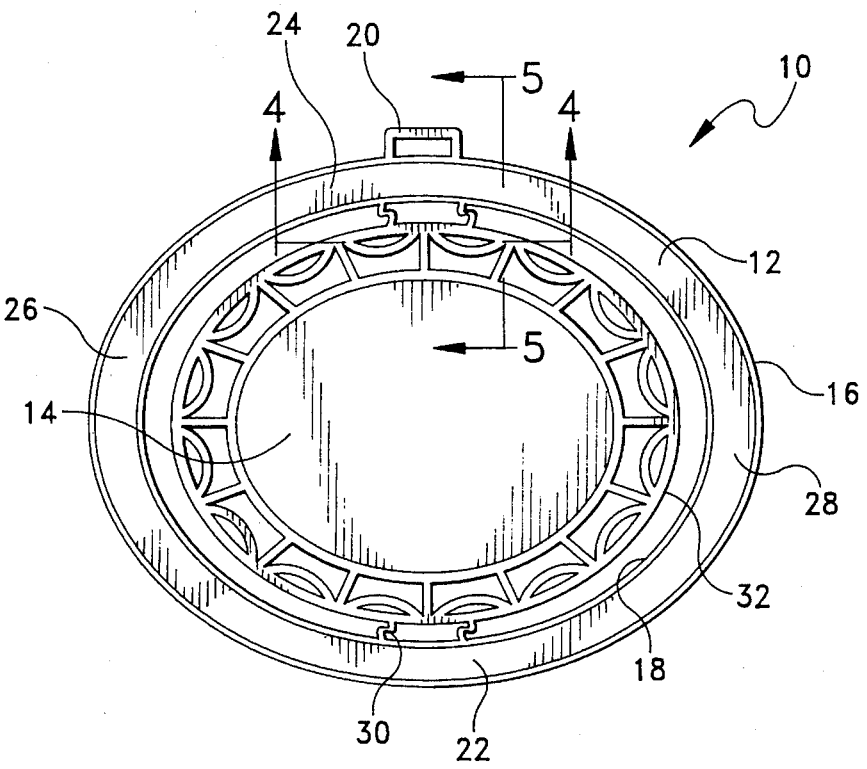
FIG. 1 is plan view showing an ornament of the present invention.

Turning now to the drawings and particularly FIG. 1, a completed three-dimensional ornament made according to the present invention is shown. Such ornament 10 includes first and second elements 12 and 14 respectively. It should be pointed out that the ornament shown in the drawings is depicted as an overall oval shape wherein the first or outer element 12 is at a relatively higher level than that of the second element 14 which is concentric therewith and parallel thereto. It should be readily apparent that this precise overall geometric shape while the preferred embodiment is not necessarily essential to the invention and that the ornament could take other geometric or irregular shapes including squares, circles, rectangles and the like. It is necessary, however, that both the elements 12 and 14 would be of an overall flat planar configuration and have at least portions of the second element which are in a spaced relationship and preferably spaced and parallel to the first element in the final configuration of the ornament.

Figure 1A:
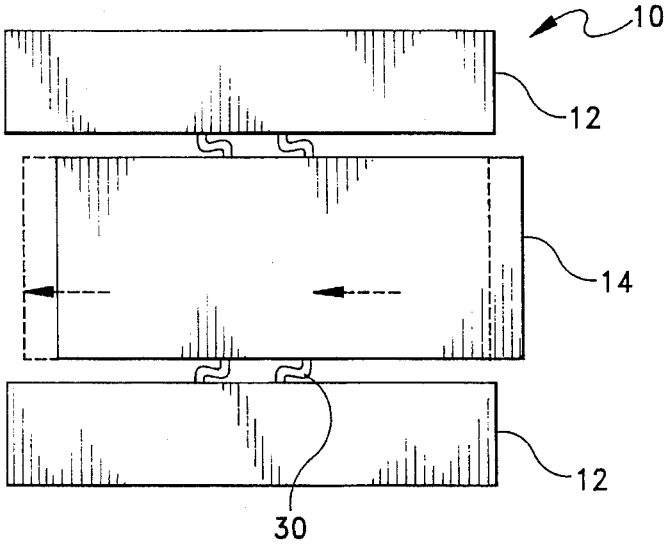
FIG. 1A through 1C are alternate geometric forms of the ornament of the present invention.
Figure 1B:
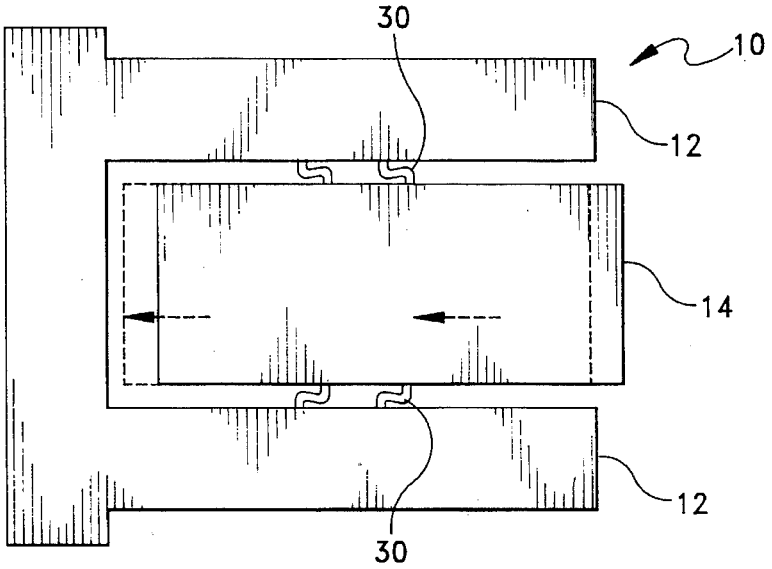
Figure 1C:
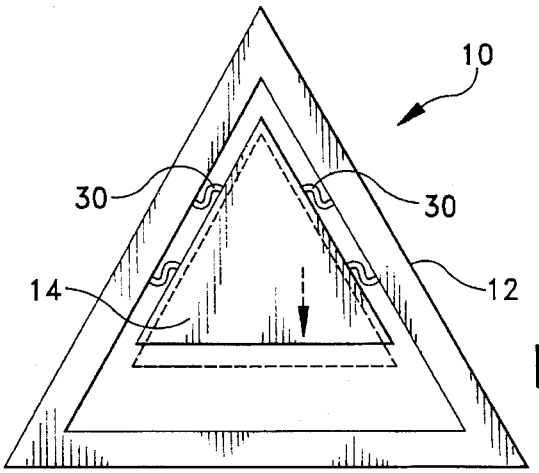
Figure 3:
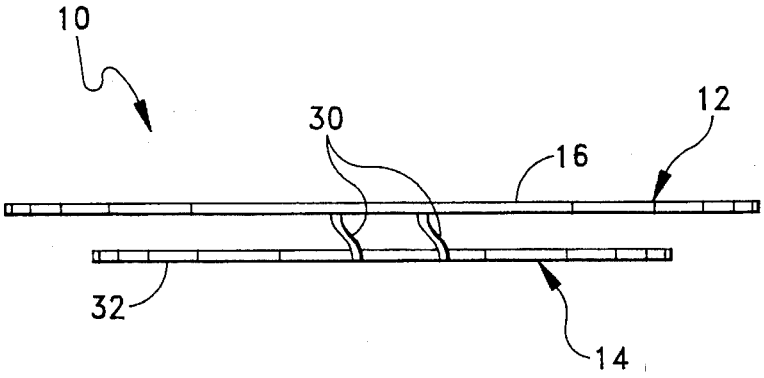
FIG. 3 is a front or edge view of the ornament of FIG. 1.

Since the ornaments are initially formed from a sheet of workable metal such as brass, copper, stainless steel and the like which is preferably somewhere between 0.012 and 0.040 inches in thickness, the basic ornament parts, that is, the first and second elements referred to above, are of the same thickness as it is contemplated that they be shaped as by blanking from such sheet, i.e., the first and second elements are integral with each other. A suitable thickness for brass sheet would be 0.020 inches, and it should be pointed out that highly decorative geometric features may be built into either or both of the design elements 12 and 14 which make up the ornament and that the sheet stock may additionally be electroplated either entirely or partially and may be selectively or entirely coated to achieve various visual effects. In addition, optional additional elements may be affixed to the ornament as by mechanical attachments, adhesion or the like. Also, it should be borne in mind that while two, that is, first and second metallic elements 12 and 14 have been depicted, it is possible to achieve further decorative effects by having multiple second elements, that is, the term second element includes both single and multiple portion elements. Also and as in part shown in FIGS. 1A, 1B and 1C, the ornament 10 can be formed in various other geometric forms which include both open and closed perimeter elements. In addition, the elements do not necessarily have to be concentric. In such drawings, the dotted lines show the displaced or final ornament position of the second element.

Turning back to FIG. 1 of the drawings, the first element 12 is in the shape of a oval having an outer edge 16 and an inner edge 18. In addition, the outer edge is provided with a suspending member 20 from which the ornament 10 may be suspended for display as from a Christmas tree branch or the like. The inner edge 18 defines a central opening and includes opposed sides 22 and 24 as well as first and second ends 26 and 28 respectively. Thus in the particular ornament 10 depicted, the sides 22 and 24 refer to the lower and upper sides respectively while the first and second ends 26 and 28 refer to the left and right sides respectively. Naturally dependent on how the ornament is hung or displayed and where identifying or ornamental indicia may be placed defines such relative terms as "upper", "lower", "front" or "side". For purposes of this description, these words are used in their broadest sense.

Thus it should be apparent that the second element 14 is of a lesser peripheral extent than that of the inner edge 18 of the first element and is connected thereto by connecting means extending inwardly from such inner edge 18 of the outer or first element to the outer edge 32 of the second element. Such connecting means are in the form of an integral strip or 30 strap that is provided for in the stamping or etching process such that it is a portion of the original blank from which the ornament is formed and is thus of the same thickness as the first and second elements and is of a narrow width such that it can be, in effect, twisted about a rotational axis parallel to the plane of the first and second elements.

Figure 4:
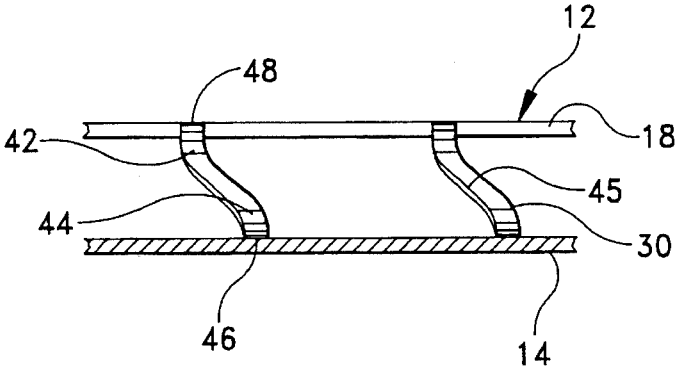
FIG. 4 is an enlarged view showing in particular one of the connecting straps and the manner in which it is twisted when manipulating the blank shown in FIG. 2 to the ornament shown in FIG. 1 and taken along the line 4—4 of FIG. 1.
Figure 5:
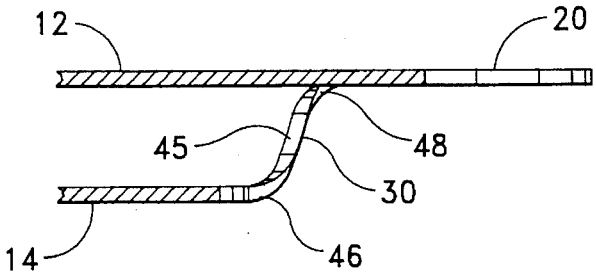
FIG. 5 is an enlarged view similar to FIG. 4 but taken along the line 5—5 of FIG. 1.
Figure 6:
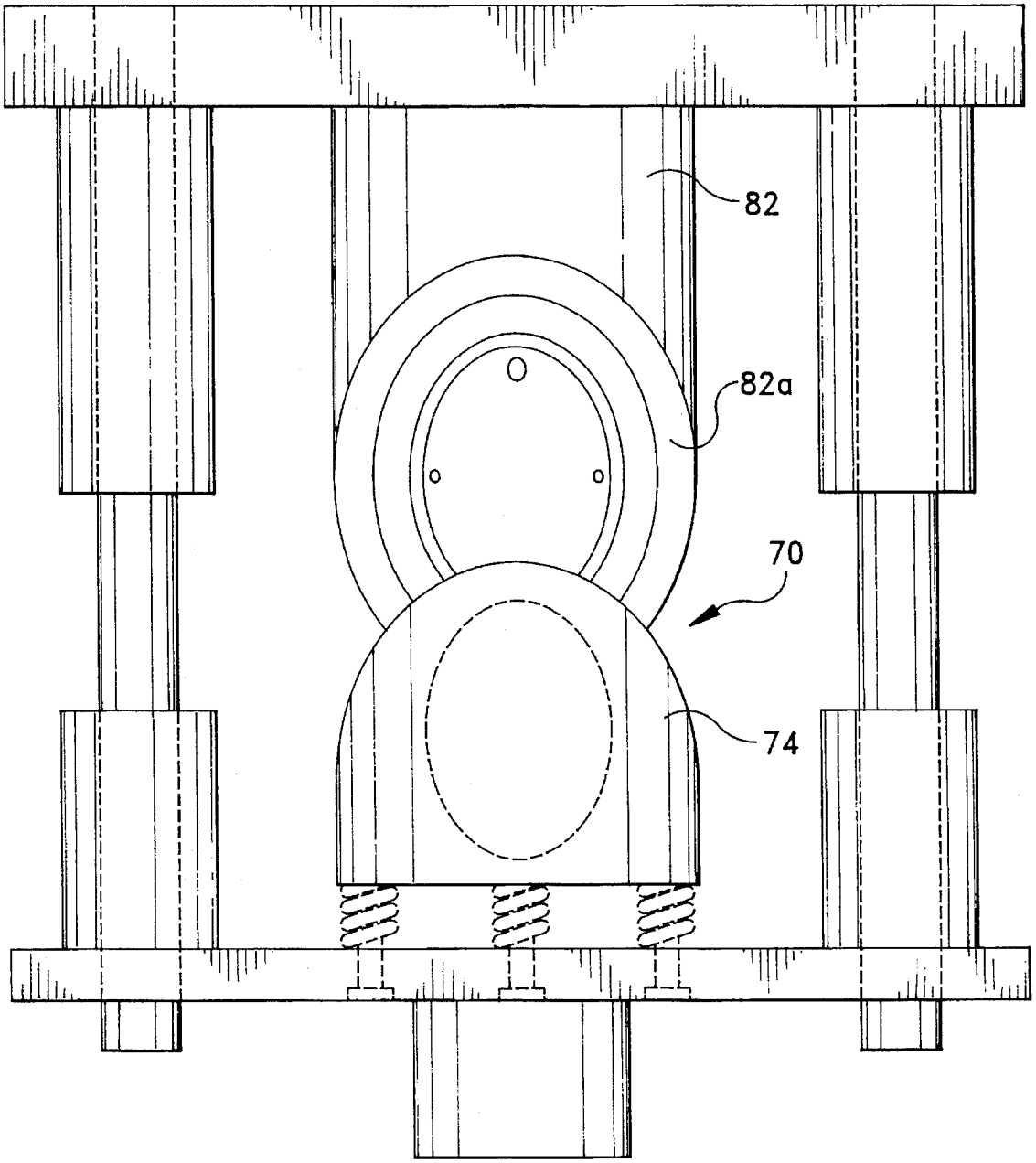
FIG. 6 is a front view of a forming die utilized to form the blank of FIG. 2 into the ornament of FIG. 1.
Figure 7:
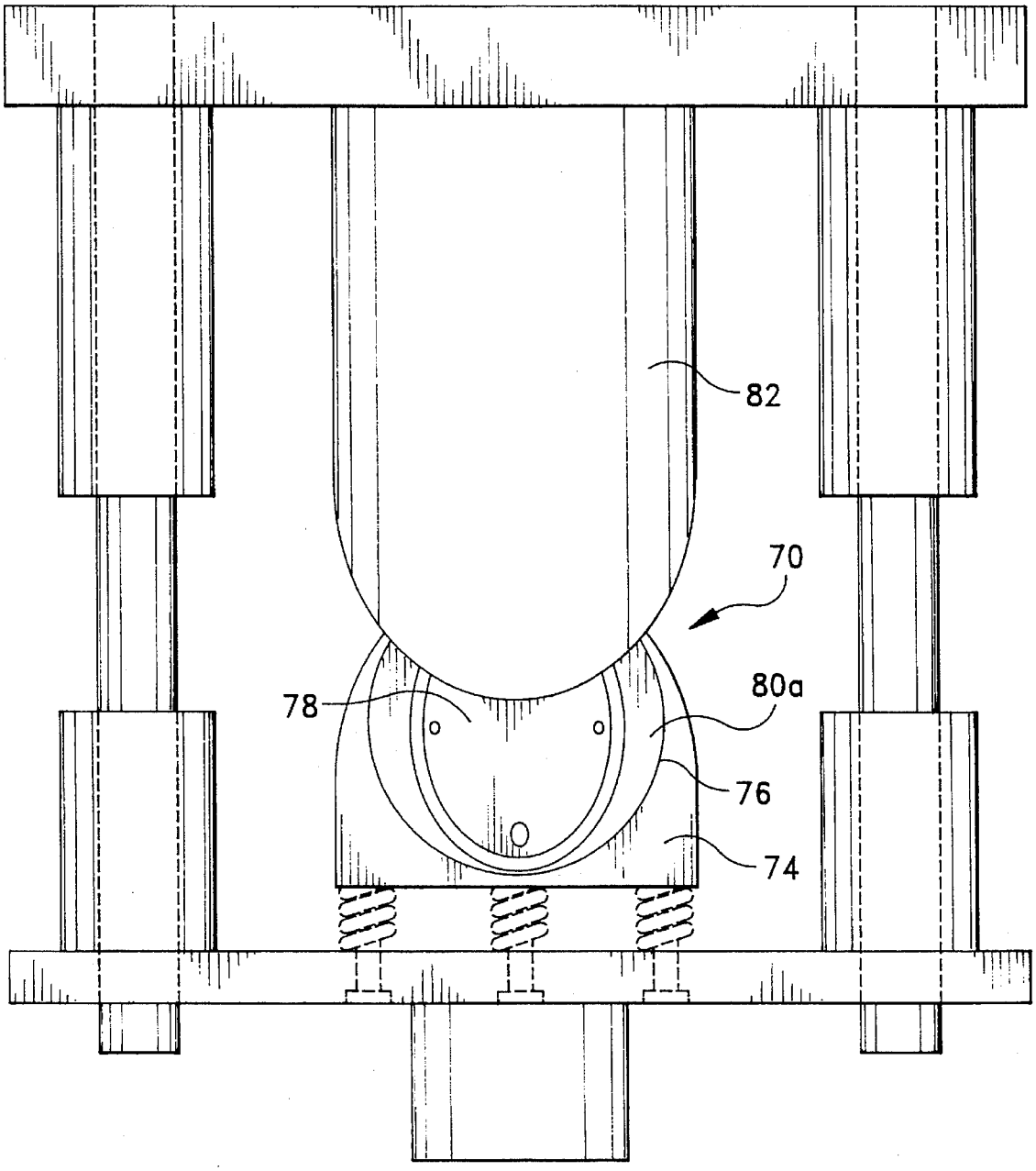
FIG. 7 is a rear view thereof.

In reality as best shown by FIG. 4, there is a slight turning or twisting of metal forming the upper and lower ends 42, 44 of the straps 30 at their points of connection (the inner edge and outer edge 46 and 48 respectively. This twisting or working of the metal insures that as the second element is moved downwardly with respect to the first element that the displacement distance whether by hand or by machine fixes the position of the second element with respect to the first element. In other words, there is no need to over stress or bend past the level at which you ultimately desire the second element to be displaced with respect to the first element in order to compensate for expected metal memory as is the case with straight bending techniques. Generally, it is preferred to provide a strap 30 on either side so that support is provided at spaced points in order to provide a desired rigidity to the final ornament and preferably two straps on each side as depicted.

It should also be brought out that the straps are preferably of an overall S or Z shape including a first connection leg 42 attached to the outer or upper first element 12, a second connection leg 44 attached to the inner or lower second element 14 and a body or central portion 45. The second connection leg in the blank form 50 is displaced to the right of the first connection point, that is, positioned closer to the second end 28 such that the leftward movement contemplated in repositioning the second element with respect to the first element causes the legs 42 and 44 to be more closely laterally positioned with respect to each other in the formed ornament 10. This S or Z shape of the straps 30 dependent on which side of the ornament they are observed also enables the body 45 thereof to, in essence, remain unbent and concentrates the forces towards the legs 42 and 44 such that the twisting or metal working above described takes place.

Figure 2:
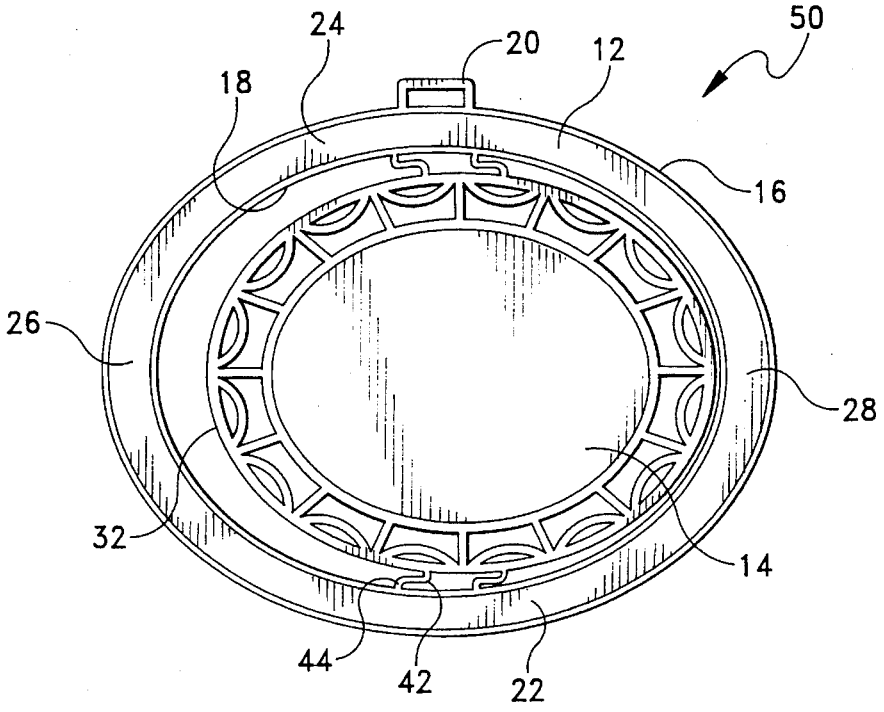
FIG. 2 is a plan view of a blank utilized to form the ornament of FIG. 1.

The reason the straps 30 are provided on the sides as shown may be explained by reference to FIG. 2 of the drawings which is a view of the blank 50 in flat form, that is, before the second element 14 has been downwardly displaced in relationship to the first element as above explained. Such blank 50 includes the outer element 12, the inner element 14 and the connecting straps 30 all on the same level, that is, in the same condition as having been cut or otherwise removed from the same sheet of sheet metal and after having been provided with the appropriate decorative electroplating or coating processes as desired. It will be seen that the second end 28 of the second element 14 is much closer to the inner edge of the first element than is the second edge thereof (as previously explained, the first and second edges correspond to the ornament left and right ends as depicted in the drawings). With such configuration, as when it is desired as in most case to present an overall ornament having the second element concentric with the first, the movement of the second element 14 in the blank form 50 will be downwardly or inwardly and to the left or towards the second end as defined. This movement is best accomplished by holding the first element in a fixed position and then simultaneously forcing the second element downwardly and to the left in order to cause the points of connection of the straps 30 with their respective edge connections to slightly twist or become deformed or worked until the desired spaced relationship is achieved.

Figure 8:
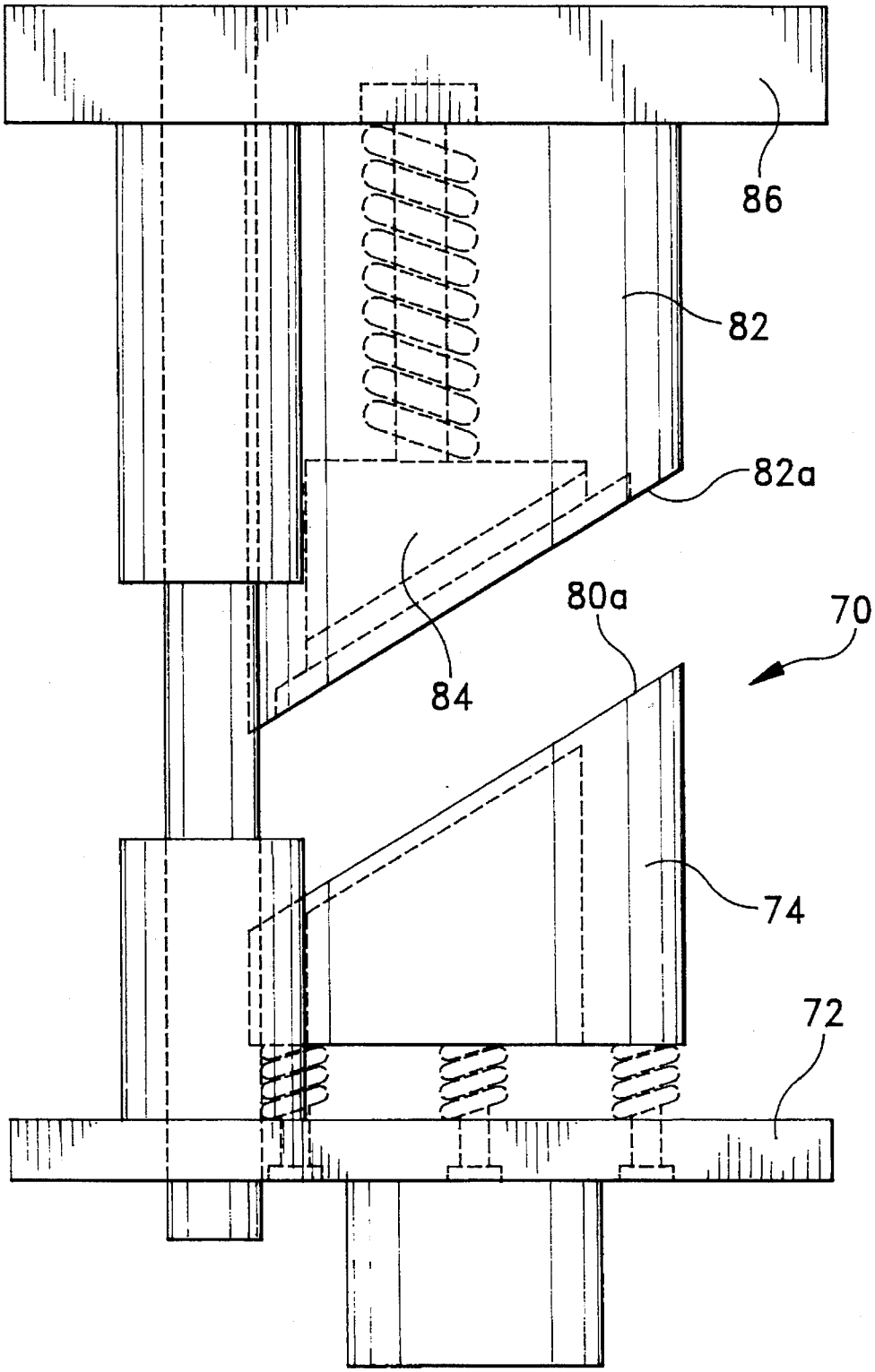
FIG. 8 is a side view of the die in its open position.
Figure 9:
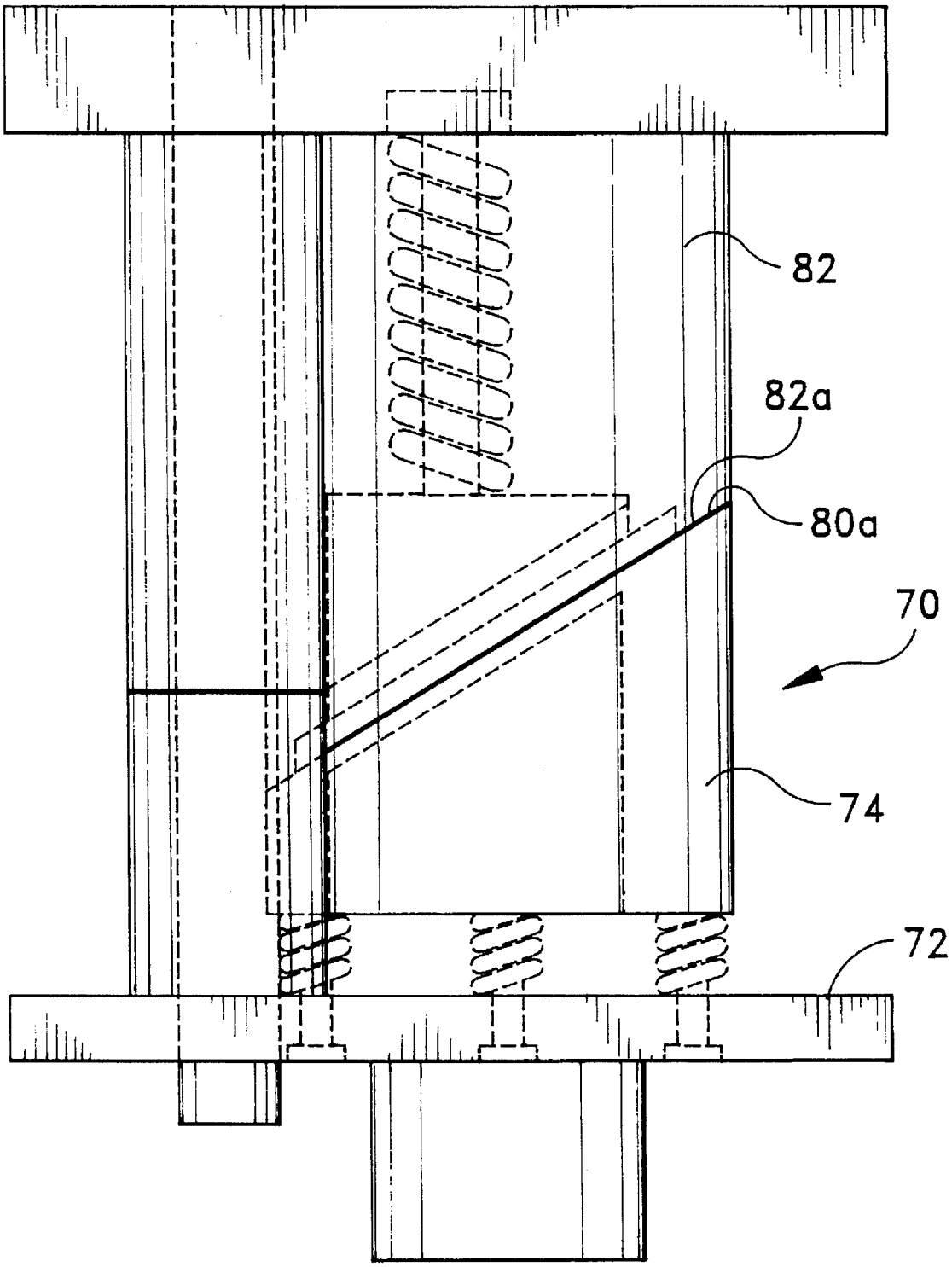
FIG. 9 is a side view of the die shown in its closed position.

As best shown in FIGS. 6 through 9, a machine 70 which accomplishes such motion is depicted. Therein, the forming machine includes a support 72 on which a lower or female die 74 is mounted. Such die 74 includes an outer stationary portion 76 and a central depression 78 respectively and which correspond to the general shape and extent of the first and second elements respectively. Such lower die 74 includes a support surface **80*a* on which the blank 50 is adapted to rest in a slanted position. The machine further includes an upper die member 82 having a fixed supporting surface 82*a* and a movable central plunger 84 respectively corresponding roughly to the shape and extent of the outer and inner or first and second elements 12 and 14. This upper die member 82 is attached to a support 86 which in turn is adapted to be moved towards and away from the lower die 74 as on a guide rod 88. As will be apparent as the upper die member moves downwardly, the surfaces 80***a* and 82*a* close upon respective upper and lower surfaces of the first element and thereafter the plunger element 84 continues its downward movement for a short distance equal to the desired spacing to be achieved between the first and second elements. Since the upper member 82 contact surface is on a diagonal as is the support of the blank, its contact and then displacement of the second element with respect to the first element forces the second element downwardly and to the left to shift the second element in such a direction with respect to the first element. Naturally, the second end 28 of the second element 14 which is most closely positioned with the inner edge of the first element is positioned upwardly or to the right as shown in FIGS. 8 and 9 so that this relative movement is achieved. Thus, it will be apparent that this downward inward movement simultaneously not only displaces the inner element downwardly but simultaneously shifts it to the left so that it is concentric with the remaining portions or the first element, and such action is achieved by inherent twisting of the connecting straps about their points of contact with their respective edges of the inner and outer elements. This twisting of the straps insures working of the metal such that the metal does not have the tendency to creep back or return to a previous position.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An ornament having first and second metallic elements, said elements each being of a thin, substantially planar sheet-like configuration of equal thickness and having opposed upper and lower surfaces, said element surfaces being of planar geometric configurations in which the first element includes an inner peripheral edge having opposed sides and ends which defines a central opening in which said second element is disposed in a parallel vertically-spaced relationship to said first element, said second element including an outer peripheral edge having opposed sides and ends, said elements integrally attached to each other by at least one integral flat connecting strap extending between said elements between each of their respective side edges, said straps being of the same thickness and material as said elements and of a narrow width and further each partially rotationally twisted about an axis parallel to the flat planes of said elements such that said elements are maintained in their spaced relation by said connecting straps.

2. The ornament of claim 1 wherein said first and second elements are positioned concentrically with respect to each other.

3. The ornament of claim 1, wherein said straps are generally S shaped having a body portion and opposed terminal legs in turn attached at attachment points to said respective elements and wherein said twisting occurs at said attachment points.

4. The ornament of claim 3, there being a pair of said straps laterally displaced with respect to each other located on each respective side of said ornament elements.

5. The ornament of claim 4 wherein said first and second elements are positioned concentrically with respect to each other.

* * * * *